United States Patent [19]

Ito et al.

[11] Patent Number: 4,686,879

[45] Date of Patent: Aug. 18, 1987

[54] KEY TOUCH ADJUSTER FOR A KEYBOARD MUSICAL INSTRUMENT

[75] Inventors: Makoto Ito; Terumi Mori; Hiroyoshi Takahashi, all of Hamamatsu, Japan

[73] Assignee: Nippon Gakki Seizo Kabushiki Kaisha, Japan

[21] Appl. No.: 824,190

[22] Filed: Jan. 30, 1986

[30] Foreign Application Priority Data

Jul. 30, 1985 [JP] Japan ..... 60-115842[U]
Jul. 30, 1985 [JP] Japan ..... 60-115843[U]

[51] Int. Cl.[4] ..... G10C 3/12
[52] U.S. Cl. ..... 84/440; 273/81 A
[58] Field of Search ..... 84/439, 440, 236, 237, 84/238, 239, 243, 453; 177/246, 247, 250, 264; 24/455, 456; 273/81 A, 81.2, 67 DB, 71

[56] References Cited

U.S. PATENT DOCUMENTS 3,422,719 1/1969 Payson ..... 273/81 A X
4,493,238 1/1985 Ricci ..... 84/453 X

FOREIGN PATENT DOCUMENTS 17636 1/1929 Australia ..... 273/81 A
93669 12/1971 France ..... 84/237

*Primary Examiner*—Michael L. Gellner
*Assistant Examiner*—Brian W. Brown
*Attorney, Agent, or Firm*—Lerner, David, Littenberg, Krumholz & Mentlik

[57] ABSTRACT

For easy and free adjustment of key touch on a keyboard musical instrument, a balancer made of an elongated leaf spring has a pair of opposed leg sections suited for elastically clamping hammer shank or hammer wood of the action assembly. Preferably, the balancer is provided with pawls for stable attachment by encroachment on the objective.

18 Claims, 11 Drawing Figures

KEY TOUCH ADJUSTER FOR A KEYBOARD MUSICAL INSTRUMENT

BACKGROUND OF THE INVENTION

The present invention relates to a key touch adjuster for a keyboard musical instrument, and more particularly relates to an improvement in construction of an action assembly of a keyboard musical instrument such as a piano.

On a keyboard musical instrument such as a piano, an action assembly is driven for operation by depression of an associated key to strike an associated string, and vibration of the string is amplified by a sound board to generate an intended sound.

Key touch, i.e. reaction of a key on the player's fingers, is set to a standard magnitude in general by embedding a weight such as a lead piece in the key at a preselected position. Since performance is greatly swayed by key touch on the player's fingers, key touch of a key should preferably match player's personal preference. However, personal preference differs greatly from player to player. For example, in the case of training at music schools, relatively heavy key touch is preferred for training of students' fingers. Such heavy key touch is, however, in general unsuited for personal preference of skilled or players. In order to adjust key touch of a key, one need to use a weight somewhat heavier than the standard. In other words, replacement of weight is necessary for adjusting key touch in accordance with player's personal preference. Such replacement is a troublesome work which requires time and labour. In addition, after removing an old weight, the old hollow for the old weight has to be closed by a wooden piece. For these reasons, it has been quite infeasible to freely and easily adjust key touch on a keyboard musical instrument all that long.

SUMMARY OF THE INVENTION

It is the object of the present invention to enable free and easy key touch adjustment on a keyboard musical instrument in accordance with players' personal preference.

According to the basic aspect of the present invention, at least one balancer is detachably coupled to the hammer of an action assembly of a keyboard musical instrument.

DESCRIPTION OF THE PREFERRED EMBODIMENTS

Figure 1:
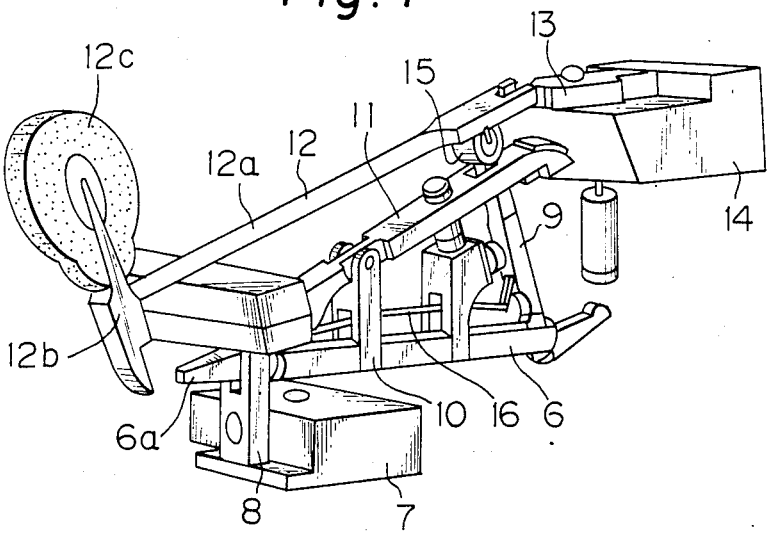
FIG. 1 is a perspective view of a typical example of an action assembly for a grand piano to which the present invention is well applicable.

FIG. 1 shows one typical example of the action assembly for a grand piano to which the present invention is well applicable. The action assembly includes a wippen 6 pivoted at the rear end to a wippen rail 7 via a wippen flange 8 and supported about the middle by a capstan (not shown) secured to the rear end of an associated key. The other end of the wippen 6 pivotally supports a jack 9. A repetition lever flange 10 secured to the wippen 5 pivotally supports a repetition lever 11 above the wippen 5. Above the repetition lever 11 is pivoted a hammer 12 to a hammer shank flange 13 on a shank flange rail 14. Near the pivot the hammer 12 is provided with a hammer roller 15 which rests on the top face of the repetition lever 11. The repetition lever 11 is accompanied with a repetition spring 16 whose repulsion pushes up the repetition lever 11 in order to register the hammer 12 at the initial rest position. The hammer 12 includes a hammer shank **12*a*, a hammer wood 12*b* and a hammer felt 12*c*. The jack 9 extends upwards through the repetition lever 11 and its top abuts against the hammer roller 15**.

On key depression, the wippen 6 swings upwards to toss the hammer 12 via the jack 9. After striking an associated string (not shown), the hammer 12 moves to resume its initial rest position due to repulsion of the spring. Shock caused by this returning motion of the hammer 12 is borne by the repetition lever 11 and a hammer shank felt (not shown) mounted to the wippen. As briefly stated above, one or more balancer is detachably coupled to the hammer of the action assembly in accordance with the present invention.

Figure 2:
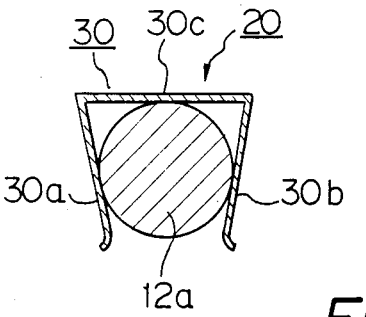
FIG. 2 is transverse cross sectional view of the first embodiment of the key touch adjuster in accordance with the present invention.

One embodiment of the key touch adjuster is shown in FIG. 2 in which the key touch adjuster 20 includes a balancer 30 attached to the hammer shank **12*a* of the hammer 12. The balancer 30 takes the form of a leaf spring extending in the longitudinal direction of the hammer shank 12*a* and having a pair of opposed leg sections 30*a*, 30*b* and a connecting section 30*c*. The two leg sections 30*a* and 30*b* are biased towards each other so that, when the balancer 30 is attached to the hammer shank 12*a*, they should elastically clamp the hammer shank 12*a*** in order to keep the attachment.

Figure 3:
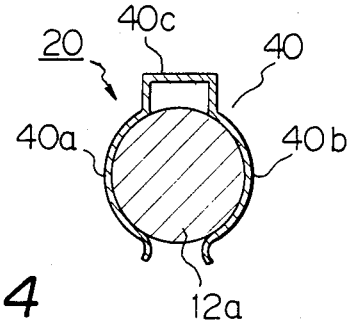
FIGS. 3 and 4 are like views of the second and third embodiments of the key touch adjuster in accordance with the present invention.

Another embodiment of the key touch adjuster is shown in FIG. 3, in which the key touch adjuster 20 includes a balancer 40 attached to the hammer shank **12*a* of the hammer 12. The balancer 40 takes the form of a leaf spring extending in the longitudinal direction of the hammer shank 12*a* and having a pair of leg sections 40*a*, 40*b* and a connecting section 40*c*. The leg sections 40*a* and 40*b* are both semicircular in transverse cross sectional profile and the largest distance between the two leg sections 40*a* and 40*b* in a free state is smaller than the smallest transversal size of the hammer shank 12*a* so that, when the balancer 40 is attached to the hammer shank 12*a*, they should elastically clamp the hammer shank 12*a*** in order to keep the attachment.

Figure 4:
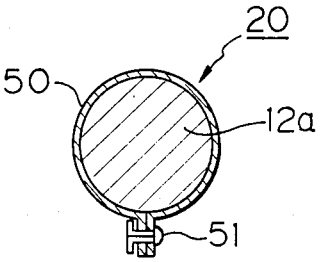

The other embodiment of the key touch adjuster is shown in FIG. 4, in which the key touch adjuster 20 includes a balancer 50 attached to the hammer shank of the hammer 12. The balancer 50 takes the form of a leaf spring extending in the longitudinal direction of the hammer shank **12*a* and having a longitudinal slit. The slitted ends of the leaf spring is fastenable by a connector 51. The largest traversal size of the leaf spring in a fastened state should be smaller than the smallest transversal size of the hammer shank 12***a* so that, when the balancer 50 is attached to the hammer shank 12*a*, it should elastically clamp the hammer shank 12*a* in order to keep the attachment.

When the key touch adjuster 20 such as shown in FIGS. 2, 3 or 4 is attached to the hammer shank 12*a* of the hammer 12, the weight of the hammer shank 12*a* is increased accordingly and a greater force is required to toss the hammer roller 15 by the jack 9. This in turn results in heavier key touch on the player's fingers.

In addition, since the key touch adjuster 20 is elastically attached to the hammer shank 12*a* and made of a simple leaf spring, the key touch adjuster 20 can be replaced and its position on the hammer shank 12*a* can be changed, both quite easily and instantly in order to freely and easily adjust key touch in accordance with player's personal preference. Further, when compared with conventional weight change on a key, a small change in weight of the key touch adjuster and/or in its position can bring about effective increase in moment. Standard key touch is easily resumed simply by detaching the key touch adjuster 20 from the hammer shank 12*a*.

Instead of the hammer shank 12*a*, the key touch adjuster 20 may be attached to the hammer wood 12*b* of the hammer 12.

Figure 5A:
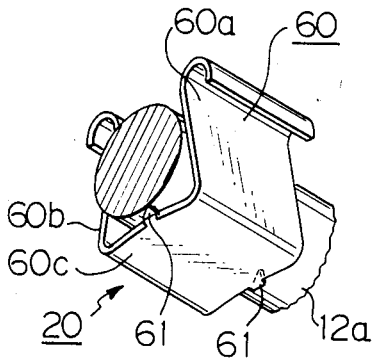
FIGS. 5A and 5B are perspective and transverse cross sectional views of the other embodiment of the key touch adjuster in accordance with the present invention.
Figure 5B:
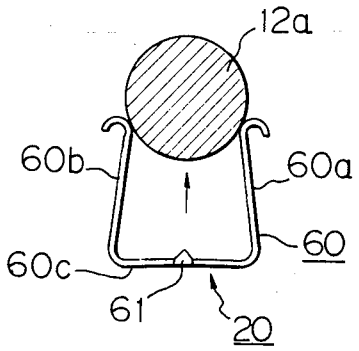

With the above-described constructions, there may be a case in which the elastic attachment allows unexpected displacement of the key touch adjuster from the initial set position due to vibrations of related parts during performance. The embodiment of the key touch adjuster shown in FIGS. 5A and 5B has a function to avoid such unexpected displacement.

More specifically, the key touch adjuster 20 includes a balancer 60 given in the form of an elongated leaf spring. The leaf spring has a pair of opposed leg sections 60*a*, 60*b* and an intermediate connecting section 60*c*. In a free state, the distance between free ends of the leg sections 60*a* and 60*b* should be smaller than the smallest transversal size of the hammer shank 12*a* so that when attached to the hammer shank 12*a*, the leg sections 60*a* and 60*b* should elastically clamp the hammer shank 12*a*. At both longitudinal ends, the connecting section 60*c* is provided with V-shaped pawls 61 projecting into the space defined by the pair of leg sections 60*a* and 60*b* which receives the hammer shank 12*a*.

When the key touch adjuster 20 is pressed against the hammer shank 12*a*, the latter is received in the space between the leg sections 60*a* and 60*b* and the pawls 61 on the connecting section 60*c* encroach on the hammer shank 12*a* in order to prohibit axial rotation and longitudinal displacement of the latter.

Figure 6:
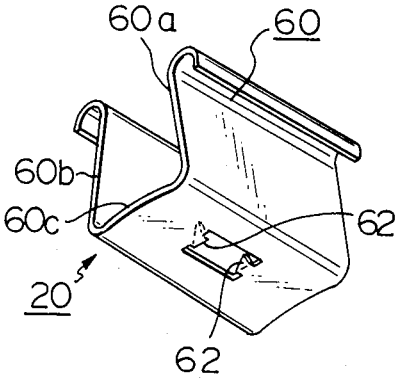
FIGS. 6 and 7 are perspective views of modifications of the key touch adjuster shown in FIGS. 5A and 5B, and FIGS. 8 to 10 are perspective views of the other embodiments of the key touch adjuster in accordance with the present invention.
Figure 7:
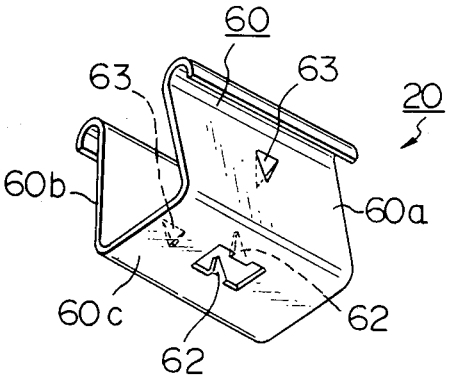

As a substitute for the pawls 61 at the longitudinal ends of the connecting section 60*c*, a pair of pawls 62 may be formed about the enter of the connecting section 60*a* by stamping as shown in FIG. 6. Further, additional pawls 63 may be formed on the leg sections 60*a* and 60*b* as shown in FIG. 7. In general the hammer shank 12*a* is made of wood and its grain runs in the longitudinal direction. The pawls 61 and 62 (see FIGS. 5A, 5B and 6) extend normal to the running direction of the grain whereas the pawls 63 (see FIG. 7) extend parallel to the same direction. The latter arrangement of pawls assures better encroachment on and less breakage of the hammer shank. The size of the pawls should be chosen so that the pawl encroachment should well endure vibration of related parts during performance.

Figure 8:
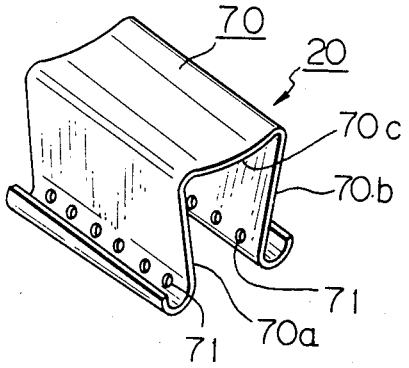

A further embodiment of the key touch adjuster is shown in FIG. 8, in which the key touch adjuster 20 includes a balancer 70 given in the form of an elongated leaf spring. The leaf spring has a pair of opposed leg sections 70*a*, 70*b* and a connecting section 70*c*. Like the foregoing embodiments, in a free state, the distance between free ends of the leg sections 70*a* and 70*b* should be smaller than the smallest transversal size of the hammer shank 12*a* so that, when attached to the hammer shank 12*a*, the leg sections 70*a* and 70*b* should elastically clamp the hammer shank 12*a*. As a substitute for the pawls 61 to 63, aligned small holes 71 are formed through the leg sections 70*a* and 70*b* near their free ends. When the key touch adjuster 20 is attached to the hammer shank 12*a*, edges of the holes 71 encroach upon the hammer shank 12*a* to prohibit axial rotation and longitudinal displacement of the latter.

Figure 9:
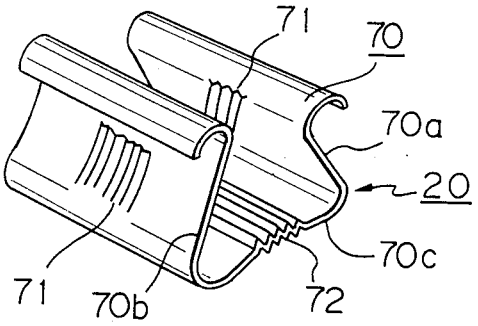

A modification is shown in FIG. 9, in which the balancer 70 includes corrugations 71 formed on the leg sections 70*a* and 70*b* and a corrugation 72 formed on the connecting section 70*c*. Preferably, the direction of the corrugations 71 is normal to that of the corrugation 72.

Figure 10:
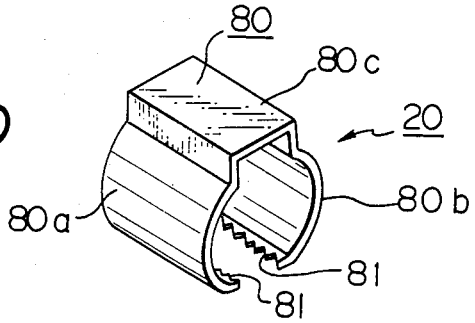

A further embodiment of the key touch adjuster is shown in FIG. 10, in which the key touch adjuster 20 includes a balancer 80 made of a leaf spring. Like the embodiment shown in FIG. 3, the leaf spring includes a pair of opposed leg sections 80*a*, 80*b* of a semicircular transverse cross sectional profile and a connecting section 80*c*. Saw teethes 81 are formed on the free ends of the leg sections 80*a* and 80*b* facing to each other.

In a broader application of the present invention, the key touch adjuster can be used as a weight balancer for sport utensils such as tennis and badminton rackets. In particular the embodiments shown in FIGS. 5A to 9 are suited for such an application since they well catch objectives via encroachment even when the objectives are moved furiously. For example, by attaching to a racket frame and changing its position of attachment, the weight balancer can easily change the center of gravity of the racket.

We claim:

1. A key touch adjuster for a keyboard musical instrument including a hammer having a maximum transverse dimension and being part of an action assembly for said keyboard musical instrument, comprising balance means comprising an elongated leaf spring movably coupled to said hammer, said leaf spring including a pair of opposed leg sections biased towards each other, whereby said pair of opposed leg sections are a predetermined distance apart when at rest and are biased towards each other when urged apart out of said rest position, said predetermined distance being less than said maximum transverse dimension of said hammer, whereby said balance means is firmly attached to said hammer when applied to a predetermined location therein.

2. The key touch adjuster of claim 1 wherein said leaf spring means includes a connecting section coupled between said pair of opposed leg sections.

3. The key touch adjuster of claim 1 wherein said pair of opposed leg sections have a semicircular transverse cross-sectional profile.

4. The key touch adjuster of claim 2 wherein said elongated leaf spring includes an inner face and said balance means includes stabilizing means disposed on said inner face of said leaf spring for preventing rotation and displacement of said balance means relative to said hammer.

5. The key touch adjuster of claim 4 wherein said stabilizing means comprises at least one pawl disposed on said inner face of said leaf spring at said connecting section.

6. The key touch adjuster of claim 4 wherein said stabilizing means comprises at least one pawl disposed on said inner face of said leaf spring on at least one of said pair of opposed leg sections.

7. The key touch adjuster of claim 5 wherein said stabilizing means comprises at least one pawl disposed on said inner face of said leaf spring at said connecting section, and at least one pawl disposed on said inner face of said leaf spring on at least one of said pair of opposed leg sections.

8. The key touch adjuster of claim 4 wherein said stabilizing means comprises a plurality of apertures disposed in said leaf spring, said apertures including edge for engaging said hammer.

9. The key touch adjuster of claim 4 wherein said stabilizing means comprises corrugation means disposed on said inner face of said leaf spring.

10. The key touch adjuster of claim 9 wherein said corrugation means is disposed on said inner face of said connecting section of said leaf spring.

11. The key touch adjuster of claim 9 wherein said corrugation means is disposed on said inner face of at least one of said leg sections of said pair of opposed leaf spring.

12. The key touch adjuster of claim 9 wherein said corrugation means is disposed on said inner face of said connecting section of said leaf spring and on said inner face of at least one of said leg sections of said pair of opposed leaf spring.

13. The key touch adjuster of claim 4 wherein said pair of opposed leg sections includes an end surface, and wherein said stabilizing means comprises teeth disposed facing each other at said end surfaces of said pair of opposed leg sections.

14. A key touch adjuster for a keyboard musical instrument including a hammer having a maximum transverse dimension and being part of an action assembly for said keyboard musical instrument comprising balance means comprising an elongated leaf spring movably coupled to said hammer, said leaf spring including a pair of opposed leg sections separated by a longitudinal slit and connector means for connecting said pair of opposed leg sections together at said longitudinal slit into a closed configuration in which said pair of opposed leg sections are separated by a predetermined distance which is less than said maximum transverse dimension of said hammer, whereby said balance means is firmly attached to said hammer when applied to a predetermined location thereon.

15. Apparatus for balancing the weight of a device which includes an elongated member having a maximum transverse dimension, said apparatus comprising an elongated elastic body including a pair of opposed leg sections biased towards each other whereby said pair of opposed leg sections are a predetermined distance apart when at rest and are biased towards each other when urged apart out of said rest position, said predetermined distance being less than said maximum transverse dimension of said elongated member whereby said elongated elastic body is firmly attached to said elongated member when applied to a predetermined location thereon.

16. The apparatus of claim 15 wherein said elongated elastic body includes an inner face, and including stabilizing means disposed on said inner face of said elongated elastic body for preventing rotation and displacement of said elongated elastic body relative to said elongated member.

17. The apparatus of claim 16 wherein said stabilizing means comprises at least one pawl disposed on said inner face of said elongated elastic body.

18. Apparatus for balancing the weight of a device which includes an elongated body member having a maximum transverse dimension, said apparatus comprising an elongated elastic body including a pair of opposed leg sections separated by a longitudinal slit, and connector means for connecting said pair of opposed leg sections together at said longitudinal slit into a closed configuration in which said pair of opposed leg sections are separated by a predetermined distance which is less than the maximum transverse dimension of said elongated member, whereby said elongated elastic body is firmly attached to said elongated member when applied to a predetermined location thereon.

* * * * *